US009412508B2

(12) United States Patent
Koch et al.

(10) Patent No.: US 9,412,508 B2
(45) Date of Patent: Aug. 9, 2016

(54) MODIFIED ELECTRICAL ACTUATION OF AN ACTUATOR FOR DETERMINING THE TIME AT WHICH AN ARMATURE STRIKES A STOP

(75) Inventors: Michael Koch, Regensburg (DE); Gerd Rösel, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 19 days.

(21) Appl. No.: 14/005,794

(22) PCT Filed: Mar. 13, 2012

(86) PCT No.: PCT/EP2012/054366

§ 371 (c)(1),
(2), (4) Date: Oct. 22, 2013

(87) PCT Pub. No.: WO2012/123445

PCT Pub. Date: Sep. 20, 2012

(65) Prior Publication Data

US 2014/0092516 A1 Apr. 3, 2014

(30) Foreign Application Priority Data

Mar. 17, 2011 (DE) ..... 10 2011 005 672

(51) Int. Cl.
*H01F 7/18* (2006.01)
*F02D 41/20* (2006.01)

(52) U.S. Cl.
CPC *H01F 7/18* (2013.01); *F02D 41/20* (2013.01); *H01F 7/1844* (2013.01); *F02D 2041/2055* (2013.01); *F02D 2041/2058* (2013.01); *H01F 2007/185* (2013.01)

(58) Field of Classification Search
CPC ..... H01F 7/18; H01F 7/1805; H01F 7/1844; H01F 2007/185; H01H 47/32; F02D 41/20; F02D 2041/2058; F02D 2041/2055
See application file for complete search history.

(56) References Cited

U.S. PATENT DOCUMENTS 5,182,517 A 1/1993 Thelen et al. ..... 324/418
5,245,501 A 9/1993 Locher et al. ..... 361/154

(Continued)

FOREIGN PATENT DOCUMENTS

CN 101688624 A 3/2010 ..... F16K 31/06
DE 3843138 A1 6/1990 ..... B60T 8/36

(Continued)

OTHER PUBLICATIONS

International Search Report and Written Opinion, Application No. PCT/EP2012/054366, 17 pages, Jun. 11, 2012.

(Continued)

*Primary Examiner* — Zeev V Kitov
(74) *Attorney, Agent, or Firm* — Slayden Grubert Beard PLLC

(57) ABSTRACT

A method is disclosed for operating an actuator having a coil and a displaceably mounted armature driven by a magnetic field generated by the coil, in a measurement operating mode for ascertaining a time at which the armature reaches its stop position after activation of the actuator. The method includes applying to the coil an actuation voltage signal dimensioned such that the expected armature stop time falls in a time window in which a temporally constant voltage is applied to the coil, detecting an intensity profile of the current flowing through the coil within the time window, and determining the armature stop time, based on an evaluation of the detected current intensity profile. A method for operating such an actuator is also disclosed, wherein information about the stop time is obtained in a measurement operating mode and used in a series operating mode for optimized actuation of the actuator.

8 Claims, 3 Drawing Sheets

(56) References Cited

U.S. PATENT DOCUMENTS

| | | | | |
|---|---|---|---|---|
| 5,592,921 | A | 1/1997 | Rehbichler | 123/490 |
| 5,835,330 | A | 11/1998 | Kirschner et al. | 361/152 |
| 6,949,923 | B2 | 9/2005 | Schultz et al. | 324/207.18 |
| 7,499,254 | B2 * | 3/2009 | Joens | 361/154 |
| 2001/0048087 | A1 * | 12/2001 | Zimmermann et al. | 251/129.05 |
| 2007/0139852 | A1 * | 6/2007 | Reuter | 361/160 |
| 2009/0015979 | A1 * | 1/2009 | Fukano et al. | 361/152 |
| 2010/0048087 | A1 | 2/2010 | Mccabe | 446/73 |
| 2012/0116702 | A1 | 5/2012 | Beer et al. | 702/65 |
| 2012/0234299 | A1 * | 9/2012 | Abe et al. | 123/490 |

FOREIGN PATENT DOCUMENTS

| | | | | |
|---|---|---|---|---|
| DE | 3942836 | A1 | 6/1991 | F02D 41/20 |
| DE | 4341797 | A1 | 6/1995 | F02D 41/20 |
| DE | 4420282 | A1 | 12/1995 | F02D 41/20 |
| DE | 4425987 | A1 | 1/1996 | F02D 29/06 |
| DE | 19834405 | A1 | 2/2000 | F02D 41/20 |
| DE | 10150199 | A1 | 4/2003 | H01F 7/18 |
| DE | 102006035225 | A1 | 2/2007 | H01F 7/122 |
| DE | 102007020969 | A1 | 11/2008 | H01F 7/18 |
| DE | 102008040860 | A1 | 7/2009 | F02D 41/20 |
| DE | 102008041528 | A1 | 3/2010 | F02D 41/22 |
| DE | 102009032521 | A1 | 1/2011 | F02D 41/20 |
| GB | 2293244 | A | 3/1996 | F02D 41/20 |
| GB | 2311559 | B | 4/1998 | F02D 41/20 |
| WO | 2012/123445 | A1 | 9/2012 | F02D 41/20 |

OTHER PUBLICATIONS

Chinese Office Action, Application No. 201280013965.3, 11 pages, May 28, 2015.

Chinese Office Action, Application No. 201280013965.3, 10 pages, May 16, 2016.

* cited by examiner

MODIFIED ELECTRICAL ACTUATION OF AN ACTUATOR FOR DETERMINING THE TIME AT WHICH AN ARMATURE STRIKES A STOP

CROSS-REFERENCE TO RELATED APPLICATIONS

This application is a U.S. National Stage Application of International Application No. PCT/EP2012/054366 filed Mar. 13, 2012, which designates the United States of America, and claims priority to DE Application No. 10 2011 005 672.2 filed Mar. 17, 2011, the contents of which are hereby incorporated by reference in their entirety.

TECHNICAL FIELD

The present disclosure relates to the technical field of electromagnetically driven actuators which comprise a coil to which an actuation signal can be applied and an armature which is mounted so as to be movable in relation to the coil. The present disclosure relates, in particular, to a method for operating an actuator having (a) a coil and (b) a displaceably mounted armature which is driven by a magnetic field which is generated by the coil, in a measurement operating mode for the purpose of determining a time at which the armature reaches its stop position after activation of the actuator. The present disclosure also relates to a method for operating such an actuator, wherein in a measurement operating mode information about the stop time is acquired and this information can be used in a series operating mode for the purpose of optimized actuation of the actuator. The present disclosure also relates to an apparatus and to a computer program for determining a time at which a displaceably mounted armature of an actuator comprising a coil reaches a stop position after activation of the actuator.

BACKGROUND

Electromagnetically driven actuators can be operated with low tolerance in the so-called full stroke operating mode. This means that an armature of the actuator is moved to and fro between a starting position and an end position. The starting position and end position are each typically defined here by a mechanical stop of the armature on a housing of the actuator. With respect to an example of an injection valve for injecting fuel, this operating mode means that a valve needle of the injection valve is respectively moved up to a maximum deflection. The injected quantity of fuel is then varied by suitably adapting the duration of the injection process.

However, in order to reduce emissions of pollutants and/or the consumption of fuel by motor vehicles it is necessary in modern injection systems to control the operation of injection valves as precisely as possible, even in the case of small injection quantities. This means that what is referred to as the ballistic operating mode of an injection valve is also controlled. The ballistic operating mode of an injection valve is understood in this context to be partial deflection of the armature or of the valve needle in a trajectory which is predefined by electrical and/or structural parameters and is free, i.e. parabolic, after the ending of the electromagnetic application of force to the armature, without reaching the full stop.

In contrast to the full stroke operating mode, the ballistic operating mode of an injection valve is subject to tolerances to a significantly greater degree, since here, both electrical and mechanical tolerances influence the opening profile to a substantially greater degree than is the case in the full-stroke operating mode. For the ballistic operating mode of an injection valve, generally of an electromagnetically driven armature of an actuator comprising a coil, the following tolerances may occur here, individually or in combination with one another:

a) Opening tolerance: the time at which the armature moves away from its starting position after a defined electrical actuation pulse has been applied to the coil depends on the electrical, magnetic and/or mechanical properties of the individual injection valve and/or on the operating state thereof (for example temperature).

b) Closing tolerance: the time at which the armature returns again to its starting position after a partial deflection depends on the electrical, magnetic and/or mechanical properties of the individual injection valve and/or on the operating state thereof.

c) Stroke tolerance: In the case of a partial deflection of the armature, the maximum stroke reached depends likewise on the electrical, magnetic and/or mechanical properties of the individual injection valve and/or on the operating state thereof. The stroke tolerance brings about an individual change in the parabolic trajectory of the armature with the possibility of the corresponding deflection curve being undesirably flattened or excessively increased.

DE 10 2006 035 225 A1 discloses an electromagnetic actuating device which has a coil. The actual movement of the actuating device can be analyzed by evaluating induced voltage signals which are caused by external mechanical influences.

DE 198 34 405 A1 discloses a method for estimating a needle stroke of a solenoid valve. During the movement of the valve needle in relation to a coil of the solenoid valve, the voltages induced in the coil are sensed and placed in relationship with the stroke of the valve needle by means of a computational model. The derivative over time dU/dt of the coil voltage can be used to determine the contact time since this signal has large jumps at the reversal point of the needle movement or armature movement.

DE 38 43 138 A1 discloses a method for controlling and sensing the movement of an armature of an electromagnetic switching element. When the switching element is switched off, a magnetic field in the exciter winding thereof is induced, said magnetic field being changed by the armature movement. The changes over time in the voltage applied to the exciter winding, which are due to said armature movement, can be used to sense the end of the armature movement.

SUMMARY

One embodiment provides a method for operating an actuator having a coil and a displaceably mounted armature which is driven by a magnetic field which is generated by the coil, in a measurement operating mode for determining a time at which the armature reaches its stop position after activation of the actuator, the method comprising applying to the coil an actuation voltage signal which is dimensioned in such a way that the expected time at which the armature strikes the stop occurs in a time window in which a temporally constant voltage is applied to the coil, acquiring the temporal profile of the intensity of the current which flows through the coil within the time window, and determining the time at which the armature reaches its stop position, on the basis of evaluation of the acquiring temporal profile of the intensity of the current.

In a further embodiment, the actuation voltage signal is dimensioned in terms of its signal level and/or its temporal profile in such a way that the expected time at which the armature strikes the stop occurs in the time window.

In a further embodiment, the actuation voltage signal has a boosting phase and a holding phase, wherein during the boosting phase a boosting voltage is applied to the coil, and during the holding phase a holding voltage is applied to the coil, wherein the boosting voltage is higher than the holding voltage.

In a further embodiment, the boosting phase is aborted as soon as the current through the coil reaches a maximum current, wherein the maximum current is selected in such a way that the expected time at which the armature strikes the stop occurs in the time window.

In a further embodiment, the boosting phase is aborted by means of a voltage pulse with reversed polarity compared to the boosting voltage, and the holding phase follows after the end of the voltage pulse.

In a further embodiment, the time at which the armature reaches its stop position is determined by an extreme value, in particular by a minimum of the intensity of the current through the coil which is sensed within the time window.

In a further embodiment, the method further comprises comparison of the acquired temporal profile of the intensity of the current with a reference current profile, wherein the determination of the time at which the armature reaches its stop position is based on evaluation of the comparison of the acquired temporal profile of the intensity of the current with the reference current profile.

Another embodiment provides a method for operating an actuator having a coil and a displaceably mounted armature which is driven by a magnetic field which is generated by the coil, the method comprising operating the actuator in a series operating mode, wherein a series actuation voltage signal is applied to the coil, said series actuation voltage signal having at least temporarily a clocked voltage for the purpose of regulating the current, and operating the actuator in a measurement operating mode for determining a time at which the armature reaches its stop position after activation of the actuator, wherein the method is carried out as disclosed above.

In a further embodiment, the series actuation voltage signal comprises a series boosting phase and a series holding phase, wherein during the series boosting phase a series boosting voltage is applied to the coil, and during the series holding phase a series holding voltage is applied to the coil, wherein the series boosting voltage is higher than the series holding voltage.

In a further embodiment, the series boosting phase is aborted as soon as the current through the coil reaches a series maximum current, wherein a maximum current for aborting a boosting phase of the actuation voltage signal is lower than the series maximum current.

Another embodiment provides an apparatus for determining a time at which a displaceably mounted armature of an actuator comprising a coil reaches a stop position after activation of the actuator, the apparatus comprising a device for applying an actuation voltage signal to the coil, said actuation voltage signal being dimensioned in such a way that the expected time at which the armature strikes the stop occurs in a time window in which a temporally constant voltage is applied to the coil, and a unit (a) for acquiring the temporal profile of the intensity of the current which flows through the coil within the time window, and (b) for determining the time at which the armature reaches its stop position, on the basis of evaluation of the acquired temporal profile of the intensity of the current.

Another embodiment provides a computer program for determining a time at which a displaceably mounted armature of an actuator comprising a coil reaches a stop position after activation of the actuator, wherein when the computer program is executed by a processor, said computer program is configured to control any of the methods disclosed above.

BRIEF DESCRIPTION OF THE DRAWINGS

Example embodiments are discussed in detail below with reference to the drawings, in which.

DETAILED DESCRIPTION

Figure 1A:
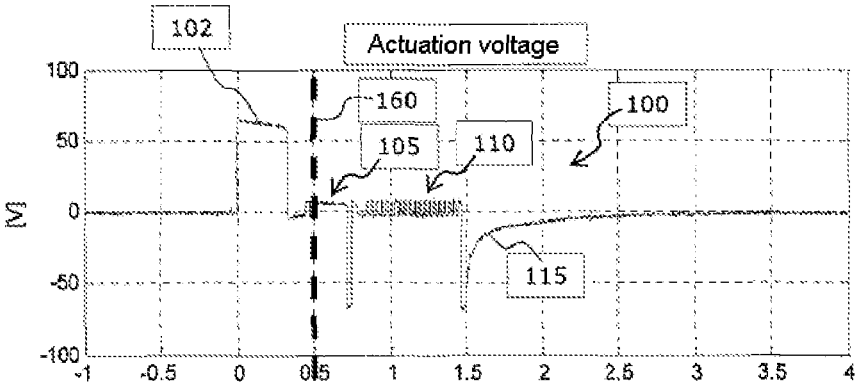
FIGS. 1*a*, 1*b* and 1*c* show, for a series actuation of a fuel injector with a boosting phase and a holding phase, the temporal profile (a) of the actuation voltage and of the resulting actuation current and (b) of the resulting injection rate.

Various embodiments of the present invention are operable to obtain, in the case of an electromagnetically driven actuator comprising a coil and a displaceably mounted armature which is operated with full deflection, knowledge about the precise time at which the armature of the actuator reaches its stop position after activation.

One embodiment provides a method for operating an actuator having (a) a coil and (b) a displaceably mounted armature which is driven by a magnetic field which is generated by the coil, in a measurement operating mode for determining a time at which the armature reaches its stop position after activation of the actuator. The described method comprises (a) applying to the coil an actuation voltage signal which is dimensioned in such a way that the expected time at which the armature strikes the stop occurs in a time window in which a temporally constant voltage is applied to the coil, (b) acquiring the temporal profile of the intensity of the current which flows through the coil within the time window, and (c) determining the time at which the armature reaches its stop position, on the basis of evaluation of the acquired temporal profile of the intensity of the current.

The described method is based on the realization that an actuator which is being operated can be operated at least temporarily in a specific measurement operating mode in which the actuator has an at least similar opening behavior and, under certain circumstances, also closing behavior, such as when the actuator is operated with normal actuation in a series operating mode. In this context, the measurement operating mode can be defined in comparison with the series operating mode, in particular, by the fact that a temporally at least approximately constant voltage is applied within a time window within which the (mechanical) stopping of the armature is expected. Then, in fact the entire electrical measurement system of the actuator is in a defined and stable state, with the result that changes over time in the intensity of the current through the coil within the time window cannot be artifacts but instead significant indications which are characteristic of the mechanical stopping of the armature.

In this context, the term "a temporally constant voltage" can mean, in particular, that no clocking is performed during which a brief first voltage pulse with a first voltage and a brief second voltage pulse with a second voltage are respectively applied to the coil in temporal succession. In this context, in particular the second voltage can also be "zero", with the result that only the first voltage is applied in the form of temporally successive discrete voltage pulses. A voltage which is effectively applied to the coil is determined, inter alia, by a pulse duty factor between (a) a first duration for which the first voltage is applied and (b) a total duration which is the sum of the first duration and of a second duration during which no voltage (or the second voltage) is applied. Of course, the effective voltage also depends substantially on the levels of the two voltages.

The described actuator can be an injector and, in particular, a fuel injection injector for a motor vehicle. The injected fuel can be gasoline or a diesel fuel.

According to one embodiment, the actuation voltage signal is dimensioned in terms of its signal level and/or its temporal profile in such a way that the expected time at which the armature strikes the stop occurs in the time window. This has the advantage that two basically different properties of the actuation signal can be set in a suitable way with the signal level and the temporal profile in order to achieve the desired stable state of the electrical measuring system of the actuator. In this context, the signal level or the voltage level can, if appropriate, be varied independently of the temporal profile in order to obtain the best possible actuation voltage signal in terms of (a) the most stable possible state of the electrical measuring system within the time window, and with respect to (b) a movement behavior of the armature which is as similar as possible to the movement behavior of the armature in a series operating mode with normal actuation.

According to a further embodiment, the actuation voltage signal has a boosting phase and a holding phase, wherein (a) during the boosting phase a boosting voltage is applied to the coil, and (b) during the holding phase a holding voltage is applied to the coil, wherein the boosting voltage is higher than the holding voltage.

The holding voltage may be, in particular, that voltage which is made available by a battery of a motor vehicle. The boosting voltage is then a voltage which is excessively increased with respect to the battery voltage and which is acquired, for example, in a known fashion from the battery voltage by means of an electrical (boost) circuit. The boosting voltage is frequently also referred to as a boost voltage.

The use of a boosting phase during a series operating mode has, in a known fashion, the advantage that the injector is activated with a high level of energy and the armature is therefore promptly deflected from its starting position. In this way, the tolerance relating to the opening behavior of various actuators of the same type is reduced and therefore a more precisely defined opening behavior and therefore a higher level of quantity accuracy of injected fuel is achieved. In the method described in this document for operating the actuator in a measurement operating mode for the purpose of determining the time at which the armature strikes the stop, the use of the boosting phase has, in particular, the advantage that the actuation voltage signal can be tailored in such a way that the opening behavior of the actuator in the measurement operating mode can be very similar to the opening behavior of the actuator in a series operating mode. The result of the described determination of the time at which the armature strikes the stop in the measurement operating mode can therefore be transferred in a good approximation to the series operating mode in which the actuator is typically also actuated using a boosting phase.

According to a further embodiment, the boosting phase is aborted as soon as the current through the coil reaches a maximum current. In this context the maximum current is selected in such a way that the expected time at which the armature strikes the stop occurs in the time window. This has the advantage that a suitable actuation voltage signal can be easily implemented.

According to a further embodiment, the boosting phase is aborted by means of a voltage pulse with reversed polarity compared to the boosting voltage. In addition, the holding phase follows after the end of the voltage pulse. This has the advantage that in the holding phase particularly stable conditions are present with respect to the voltage which is actually present at the coil. This results in the current through the coil having a low gradient in the time window defined above, with the result that the time at which the armature strikes the stop can be determined particularly precisely.

According to a further embodiment, the time at which the armature reaches its stop position is determined by an extreme value of the intensity of the current through the coil which is sensed within the time window. The extreme value may be, in particular, a minimum. This has the advantage that the time at which the armature strikes the stop can be determined particularly easily.

It is to be noted that the extreme value is, in particular, a local extreme value compared to the total current profile. With respect to the time window, the extreme value can be a local extreme value or a global extreme value.

According to a further embodiment, the method also comprises comparing the acquired temporal profile of the intensity of the current with a reference current profile. In this case, the determination of the time at which the armature reaches its stop position is based on evaluation of the comparison of the acquired temporal profile of the intensity of the current with the reference current profile.

Through the described comparison of the current measuring signal with the reference current profile it is possible to obtain a particularly high level of accuracy with respect to the determination of the time at which the armature strikes the stop. This may be due, in particular, to the fact that artifacts which occur both in the acquired current measuring signal and in the reference current profile can easily be eliminated. The comparison preferably merely comprises simple forming of differences (if appropriate with additional scaling) between the acquired temporal profile of the intensity of the current and the reference current profile.

The described reference current profile, which can be characteristic of a specific type of actuator or even of an individual actuator, can be determined, for example, on a test bench. The described reference current profile may be stored, for example, in an engine controller of a motor vehicle.

The reference current profile may be characteristic of a clamped actuator in which the armature is mechanically secured in its starting position and does not move in relation to a housing of the actuator despite the actuation voltage signal being applied to the coil. The mechanical securement can be achieved, in particular, on a test bench by means of a significantly increased fuel pressure in a rail system to which the respective actuator is connected.

Another embodiment provides a method for operating an actuator having (a) a coil and (b) a displaceably mounted armature which is driven by a magnetic field which is generated by the coil.

The described method comprises (a) operating the actuator in a series operating mode, wherein a series actuation voltage signal is applied to the coil, said series actuation voltage signal having at least temporarily a clocked voltage for the purpose of regulating the current, and (b) operating the actuator in a measurement operating mode for determining a time at which the armature reaches its stop position after activation of the actuator. The method described above is carried out in the measurement operating mode.

The described method is based on the realization that during the ongoing operation of, for example, an internal combustion engine, in the meantime the series actuation voltage signal has not been applied to the actuator but instead the actuation voltage signal described above which permits, at least in the time window defined above, the time at which the armature has reached its stop position (in the measurement operating mode), to be determined. On the basis of the determined time at which the armature actually strikes the stop (in the measurement operating mode), conclusions can then be drawn as to how, in a subsequent series operating mode, the series actuation voltage signal can, if appropriate, be adapted in order to achieve optimized activation of the coil in order to bring about a desired opening behavior of the actuator.

This method may provide the advantage that an actuator-specific adaptation for optimum actuation is possible. In this way, changes in the opening behavior of an actuator owing, for example, to wear and/or particular operating conditions, can be compensated. Changed operating conditions can be, for example, different fuel pressures, unusual viscosity of a fuel to be injected and/or unusual temperatures.

Since the series actuation voltage signal will typically be a signal which is optimized in order to bring about a desired opening and closing behavior, in this document the actuation voltage signal described above is also referred to as a modified actuation voltage signal.

The term clocked voltage is to be understood, in particular, as meaning that the applied voltage is discretely varied between two different voltage levels by a sequence of successive short pulses, with the result that, averaged over time an effective voltage, lying between the two voltage levels, is set. As described above, one of these voltage levels can also be "zero", and the value of the effective voltage arises, inter alia, in a known fashion from the pulse duty factor, as is likewise described above.

According to one embodiment, the series actuation voltage signal comprises a series boosting phase and a series holding phase. During the series boosting phase, a series boosting voltage is applied to the coil, and during the series holding phase a series holding voltage is applied to the coil, wherein the series boosting voltage is higher than the series holding voltage. The series holding voltage can also be here, in particular, that voltage which is made available by a battery of a motor vehicle. The series boosting voltage is then a voltage which is excessively increased compared to the battery voltage and which is acquired from the battery voltage in, for example, a known fashion by means of an electric (boost) circuit. The series boosting voltage can therefore also be referred to as a series boost voltage.

According to one further embodiment, the series boosting phase is aborted as soon as the current through the coil reaches a series maximum current, wherein a maximum current for aborting a boosting phase of the actuation voltage signal is lower than the series maximum current. This has the advantage that a suitable (modified) actuation voltage signal can easily be implemented for the measurement operating mode, in the case of which actuation voltage signal, on the one hand, (a) the electrical actuation is modified strongly enough to bring about reliable determination of the time at which the armature strikes the stop, and in the case of which actuation voltage signal, on the other hand, (b) the electrical actuation is not modified compared to the series operating mode to such an extent that the information acquired about the actual stopping time cannot be transferred to the series operating mode.

Another embodiment provides an apparatus for determining a time at which a displaceably mounted armature of an actuator comprising a coil reaches a stop position after activation of the actuator. The described apparatus has (a) a device for applying an actuation voltage signal to the coil, said actuation voltage signal being dimensioned in such a way that the expected time at which the armature strikes the stop occurs in a time window in which a temporally constant voltage is applied to the coil, and (b) a unit (b1) for acquiring the temporal profile of the intensity of the current which flows through the coil within the time window, and (b2) for determining the time at which the armature reaches its stop position, on the basis of evaluation of the acquired temporal profile of the intensity of the current.

The described apparatus is also based on the realization that an actuator can be operated at least temporarily in a specific measurement operating mode in which it has a similar opening behavior to that which it would have if it were operated in a series operating mode with normal actuation. During a time window within which the (mechanical) stopping of the armature is expected, a voltage which is at least approximately constant over time is present at the coil. In fact, the entire electrical measurement system of the actuator is then in a defined and stable state, with the result that changes over time in the intensity of the current through the coil within the specified time window cannot be artifacts but instead significant indications which are characteristic of the mechanical stopping of the armature.

Another embodiment provides a computer program for determining a time at which a displaceably mounted armature of an actuator comprising a coil reaches a stop position after activation of the actuator. When the computer program is executed by a processor, said computer program is configured to control the method described above to operate an actuator in a measurement operating mode in order to determine a time at which the armature reaches its stop position after activation of the actuator.

It is to be noted that embodiments of the invention have been described with reference to different subject matters of the invention. In particular, a number of embodiments of the invention with apparatus claims and other embodiments of the invention with method claims have been described. However, on reading this application a person skilled in the art will understand immediately that, unless specifically stated otherwise, in addition to a combination of features which are associated with one type of subject matter of the invention, any desired combination of features which are associated with different types of subject matter of the invention is also possible.

Further advantages and features of the present invention emerge from the following exemplary description of a currently preferred embodiment.

It is to be noted that the example embodiment described below merely constitutes a restricted selection of possible embodiment variants of the invention.

Figure 1B:
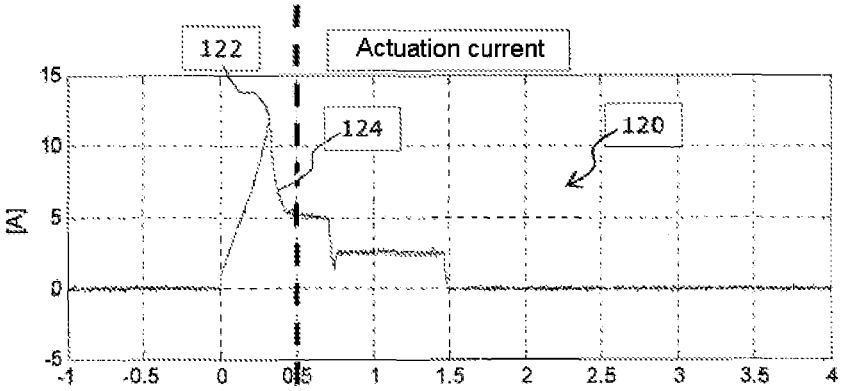
Figure 1C:
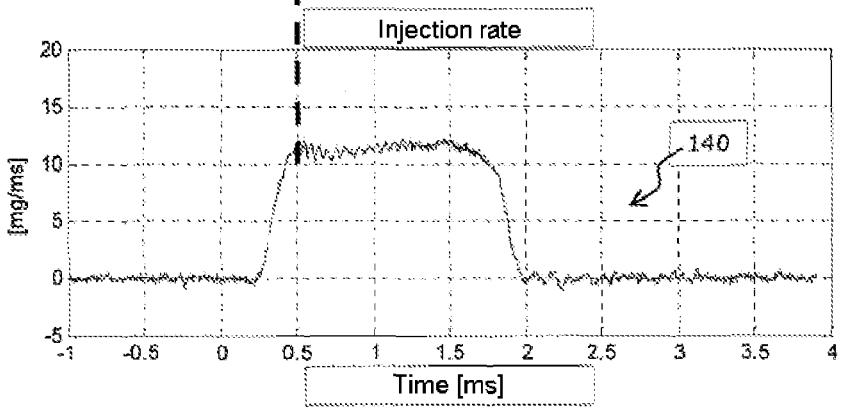

The FIGS. 1*a*, 1*b* and 1*c* show, for a series actuation of a fuel injector with a boosting phase and a holding phase, the temporal profile (a) of the actuation voltage 100 and of the resulting actuation current 120 and (b) of the resulting injection rate 140. It is to be noted, that according to the exemplary embodiment illustrated here, the series actuation corresponds to known actuation of a fuel injector, comprising a boost phase. According to the exemplary embodiment illustrated here, this series actuation is used as standard actuation, which, however, is replaced in the meantime by measurement actuation in order to be able to precisely determine the time at which the armature strikes the stop after activation of the fuel injector and, in order to be able to optimize the subsequent series actuation on the basis of the acquired information relating to the armature striking the stop.

As is apparent from FIGS. 1*a*, 1*b* and 1*c*, in the series actuation the actuation voltage 100 has, at the start of the actuation in the time range between 0 ms and approximately 0.3 ms, a boosting phase 102 with which a boost voltage of the level of approximately 60 V is applied to the coil of the fuel injector. At the same time, the actuation current 120 through the coil begins to rise. The steepness of the rise depends in a known fashion on the inductivity of the coil of the fuel injector. When a maximum current 122 is reached, said maximum current 122 being approximately 12.5 A according to the exemplary embodiment illustrated here, the boosting phase is aborted. In this context, the actuation voltage 100 drops away suddenly and the actuation current 120 falls to a level of approximately 5 A. The range between approximately 0.3 ms and 0.5 ms, in which the actuation current 120 drops exponentially owing to the inductivity of the coil, is also referred to as free-wheeling phase 124.

In order to achieve prompt movement of the armature of the fuel injector towards its mechanical stop, according to the exemplary embodiment illustrated here it is ensured that up to a time at approximately 0.75 ms the actuation current 120 does not drop below a current level of 5 A. This is achieved by virtue of the fact that in the range from approximately 0.3 ms to approximately 0.7 ms, clocking of the voltage 105 is carried out. It is to be noted that the drop in the actuation voltage 100 in the time range between approximately 0.3 ms and 0.4 ms to a slightly negative value is a measurement artifact and that in the entire time range from approximately 0.3 ms to 0.7 ms the actual voltage which is present at the coil is, due to the voltage clocking 105, at an at least approximately constant effective voltage level.

From FIG. 1*c* it is clear that at a time at approximately 0.5 ms the injection rate 140 reaches its maximum value of approximately 12 mg/ms. From this it can be concluded that according to the exemplary embodiment illustrated here the armature of the fuel injector reaches its mechanical stop at this time, which is illustrated by a dashed line 160.

As is apparent from FIG. 1*a*, in the case of the series actuation of the time 160 when the armature strikes the stop occurs within a time window in which the voltage clocking 105 described above takes place. However, the voltage clocking 105 ensures that there is an "unsteady measuring environment", with the result that, for example, the actuation current 120 cannot be evaluated with such precision as is necessary for determining striking of the armature against the stop 160 merely on the basis of electrical data. In this context, it is to be noted that the injection rate 140 can be measured only on a fuel injector measuring bench. During the real operation of the fuel injector, corresponding through-flow rate measurements are generally not possible.

For the sake of completeness, at this point reference will also be made briefly to further characteristics of the electrical series actuation of the fuel injector which is illustrated in FIGS. 1*a* and 1*b*: in order to avoid unnecessarily increasing the electrical input of energy into the fuel injector, after the striking of the armature against the stop 160 at approximately 0.7 ms further clocking of the voltage 110 is performed, which clocking results, owing to a changed pulse duty factor, in a lower effective voltage (present at the coil of the fuel injector). According to the exemplary embodiment illustrated here, this further voltage clocking 110 starts at approximately 0.75 ms and ends at approximately 1.45 ms. As is apparent form FIG. 1*b*, the further voltage clocking 110 brings about an actuation current 120 of approximately 2.5 A in the exemplary embodiment shown.

The negative voltage pulse apparent at approximately 0.7 ms (also referred to as negative boost voltage) is applied in this case in order to bring about rapid dropping of the coil current (in the illustrated case the coil current drops from approximately 5 A to approximately 2.5 A).

According to the exemplary embodiment illustrated here, the electrical actuation of the fuel injector ends at approximately 1.45 ms. As is apparent from FIG. 1*a*, a self-induction voltage is produced at the coil of the fuel injector as a result of the corresponding switching off of the actuation voltage 100. This results in turn in a flow of current through the coil, which then eliminates the magnetic field. After a recuperation voltage of approximately 70 V (illustrated here negatively) has been exceeded no further current flows. This state is also referred to as "open coil". Owing to the ohmic resistances of the magnetic material of the armature, the eddy currents induced when the coil field is eliminated decay. The reduction in the eddy current leads in turn to a change in the field in the coil and therefore to induction of a voltage. This induction effect causes the voltage value at the coil of the fuel injector to rise to zero starting from the level of the recuperation voltage according to the profile of an exponential function 115. After the elimination of the magnetic force the fuel injector closes by means of the spring force and the hydraulic force caused by the fuel pressure.

The end of the electrical actuation can be seen in FIG. 1*b* from the fact that at approximately 1.45 ms the actuation current 120 drops to a value of zero. From FIG. 1*c* it is apparent that after a certain time delay (cf. the closing tolerance described above) the armature of the fuel injector begins to close at approximately 1.75 ms.

In order to permit the best possible measuring conditions for precise electrical analysis of the current signal of the actuation current through the coil in the time window in which the armature of the fuel injector is expected to strike the stop, and in order to achieve at least a similar opening ad, if appropriate, also closing behavior to that in the case of the series actuation, according to the exemplary embodiment described below with reference to figures 2*a*, 2*b* and 2*c* the coil of the fuel injector is actuated in such a way that it is possible to dispense with voltage clocking.

Figure 2A:
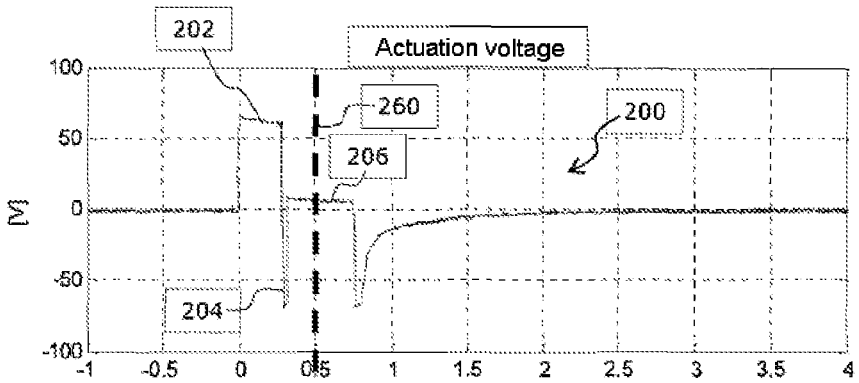
FIGS. 2*a*, 2*b* and 2*c* show, for measurement actuation of a fuel injector with a modified boosting phase and a modified holding phase, the temporal profile (a) of the corresponding actuation voltage and of the resulting actuation current and (b) of the resulting injection rate.
Figure 2B:
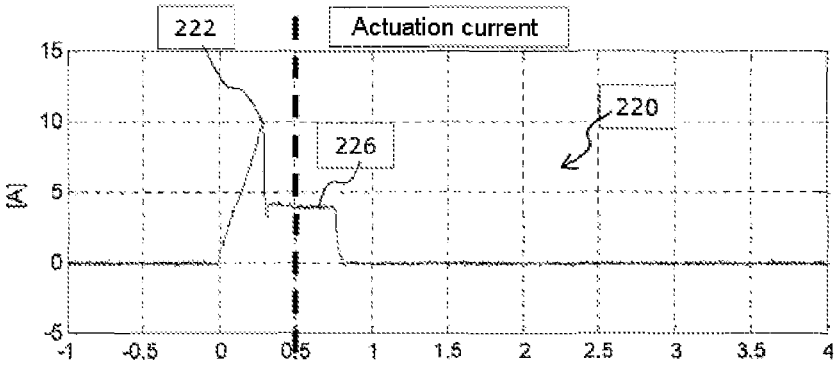
Figure 2C:
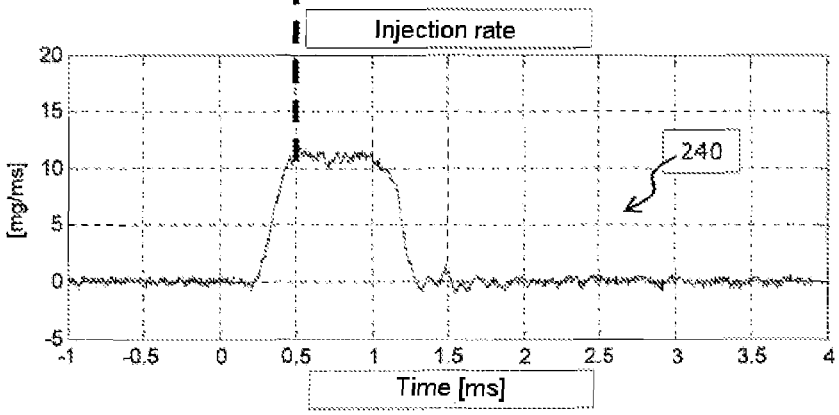

Figures 2*a*, 2*b* and 2*c* show, for measurement actuation of a fuel injector with a modified boosting phase and a modified holding phase, the temporal profile (a) of the corresponding actuation voltage 200 and of the resulting actuation current 220 and (b) of the resulting injection rate 240. The time at which the armature strikes the stop is illustrated with the dashed line provided with the reference symbol 260.

As is apparent from the comparison between FIGS. 2*b* and 1*b*, in the case of the measurement actuation modified compared to the series actuation a relatively small maximum current 222 is selected with the result that the boosting phase 202 is aborted somewhat earlier. Compared to the maximum current 122, which is approximately 12 A in the series actuation, the maximum current 222 of the measurement actuation is merely approximately 20 A. In addition, at the time at which the boosting phase 202 ends at approximately 0.35 ms a brief negative voltage pulse 204 is actively applied to the coil in order to draw the coil current (here approximately 10

A) promptly to a lower level. After implementation of these two measures (a) of the selection of a somewhat smaller maximum current 222 and (b) the active drawing down of the current by the brief negative voltage pulse 204 it is subsequently possible, i.e. in a time window from approximately 0.35 ms to 0.75 ms in which the striking of the armature against the stop is expected, to dispense with clocking of the voltage. As a result, an unclocked voltage plateau 206 and a current plateau 226 with a substantially smoother current profile compared to the current profile 120 illustrated in FIG. 1*b* are obtained. As is described in more detail below, in the case of "steady measuring conditions" it is therefore possible to determine, through precise analysis of the current plateau 226, the time at which the armature of the fuel injector reaches its mechanical stop.

It is to be noted that according to the exemplary embodiment illustrated here, the current plateau 226 constitutes the start of an exponential rise in the actuation current 220, which rise is caused in a known fashion by the inductivity of the coil to which a constant voltage is applied. Through skillful selection of a suitable (reduced) value for the maximum current 222 and, in particular, through the use of the negative voltage pulse 204, it is, however, ensured that this rise is still so flat in the time window from approximately 0.35 ms to approximately 0.75 ms that the current in this time window to be temporally constant in a good approximation.

For the sake of completeness, at this point brief details will also be given about further characteristics of the electrical measurement actuation of the fuel injector which is illustrated in figures 2*a* and 2*b*. At a time of approximately 0.75 ms the electrical actuation of the fuel injector ends. In the same way as in the case of the series actuation, the switching off of the actuation voltage 200 at the coil of the fuel injector brings about a negative self-induction voltage and subsequently an exponential rise in the actuation voltage to the value zero. At the time of approximately 0.75 ms the coil current 220 drops to zero. From FIG. 2*c* it is apparent that after a certain time delay (cf. the closing tolerance described above), the armature of the fuel injector begins to close at approximately 1 ms.

Figure 3A:
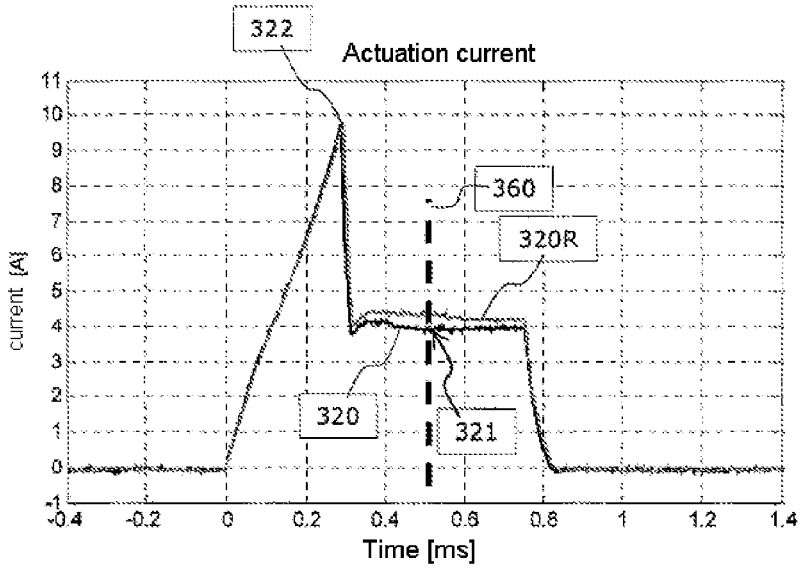
FIG. 3*a* shows a comparison between the actuation current (illustrated in FIG. 2*b*) and an actuation current which occurs when the same actuation voltage is used in the case of a hydraulically blocked fuel injector.
Figure 3B:
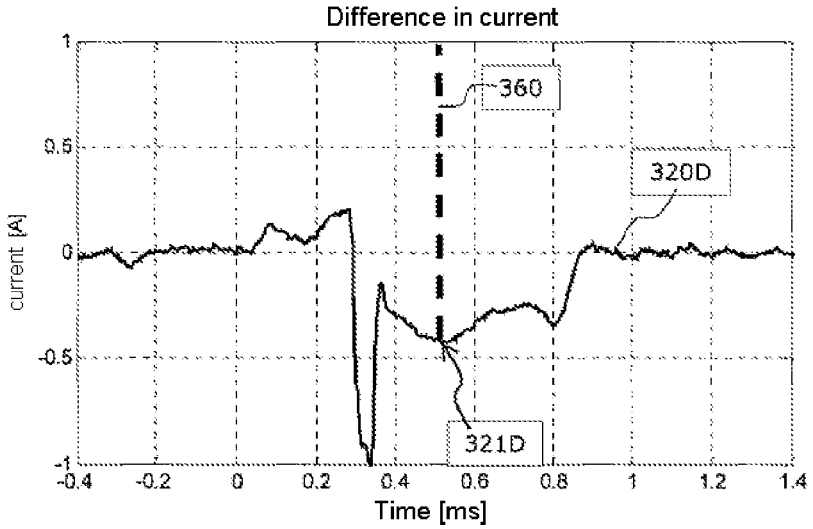
FIG. 3*b* shows, on an enlarged scale, the difference between the two actuation currents illustrated in FIG. 3*a*.

FIG. 3*a* shows a comparison between the actuation current illustrated in FIG. 2*b*, which actuation current is now characterized by the reference symbol 320, and an actuation current 320R which is set when the same actuation voltage is used in the case of a hydraulically blocked fuel injector. FIG. 3*b* shows, on an enlarged scale, the difference between the two actuation currents 320 and 320R illustrated in FIG. 3*a*.

From the illustration in FIG. 3*a*, which is enlarged compared to FIG. 2*b*, it becomes apparent that striking of the armature against the stop occurs at a time at which the actuation current 320 has a local minimum 321, albeit a flat one. Owing to the stable electrical measuring conditions which have been provided with the measurement actuation described above, at least within the time window between approximately 0.35 ms and 0.75 ms, the measuring curve 320 of the actuation current is, however, so precise that this minimum 321 can actually be detected with sufficiently high reliability.

In order to increase the detection reliability further, the measuring curve 320 of the actuation current can be compared with the above-mentioned reference actuation current 320R which is characteristic of an armature which is electrically supplied with the actuation voltage 200 but is mechanically clamped. According to the exemplary embodiment illustrated here, the comparison comprises simply forming differences, the result of which is illustrated in FIG. 3*b*. The corresponding curve 320D therefore represents the difference between the actuation current 320 and the reference actuation current 320R. In this context it is clearly apparent that the time at which the armature strikes against the stop 360 is now characterized by a substantially more clearly pronounced minimum 321D. The time at which the armature strikes against the stop 360 can therefore be determined more precisely and, in particular, with a greater degree of reliability.

It is to be noted that during the operation of an internal combustion engine intermediate mechanical clamping of the fuel injector, for example due to the application of an excessively increased fuel pressure, is typically not possible. However, the reference actuation current 320R, which can be characteristic of a certain type of fuel injector or even of an individual fuel injector, can be determined, for example, on a test bench and then stored in an engine controller of a motor vehicle. If the measurement actuation described here is then carried out during the operation of the motor vehicle, this reference actuation current 320 can be retrieved from a memory of the engine controller and used for reliable determination of the actual striking of the armature against the stop 360.

What is claimed is:

1. A method for operating an actuator having a coil and a displaceably mounted armature driven by a magnetic field generated by the coil, in a measurement operating mode for determining a time at which the armature reaches a full open position by striking against a mechanical stop after activation of the actuator, the method comprising:

applying a boosting voltage to the coil during a boosting phase, aborting the boosting phase by suddenly applying to the coil a voltage having a reduced magnitude or reversed polarity compared to the boosting voltage, after aborting the boosting phase, applying a temporally constant holding voltage to the coil during a holding phase, wherein the holding voltage is lower than the boosting voltage, wherein the armature strikes the stop during a time window during the holding phase in which the temporally constant holding voltage is applied to the coil, acquiring the temporal profile of an intensity of a current flowing through the coil within the time window in which the temporally constant voltage is applied to the coil, and determining a time at which the armature strikes the stop based on an evaluation of acquired temporal profile of the intensity of the current.

2. The method of claim 1, wherein at least one of a signal level and a temporal profile of the actuation voltage signal is selected such that the expected time at which the armature strikes the stop during the time window in which the temporally constant holding voltage is applied to the coil.

3. The method of claim 1, comprising aborting the boosting phase upon the current through the coil reaching a maximum current, wherein the maximum current is selected such that the expected time at which the armature strikes the stop occurs in the time window in which the temporally constant the armature reaches the stop position occurs in the time window in which the temporally constant holding voltage is applied to the coil.

4. The method of claim 1, comprising determining the time at which the armature strikes the stop based on a determined minimum of the intensity of the current through the coil within the time window in which the temporally constant voltage is applied to the coil.

5. The method of claim 1, comprising comparing the acquired temporal profile of the intensity of the current with a reference current profile, wherein the determination of the time at which the armature strikes the stop is based on an evaluation of the comparison of the acquired temporal profile of the intensity of the current with the reference current profile.

6. A method for operating an actuator having a coil and a displaceably mounted armature driven by a magnetic field generated by the coil, the method comprising:

operating the actuator in a series operating mode, wherein a series actuation voltage signal is applied to the coil, said series actuation voltage signal having at least temporarily a clocked voltage for regulating the current, and operating the actuator in a measurement operating mode to determine a time at which the armature reaches a fully open position by striking against a mechanical stop after activation of the actuator wherein determining the time at which the armature reaches a stop position comprises:

applying a boosting voltage to the coil during a boosting phase, aborting the boosting phase by suddenly applying to the coil a voltage having a reduced magnitude or reversed polarity compared to the boosting voltage, after aborting the boosting phase, applying a temporally constant holding voltage to the coil during a holding phase, wherein the holding voltage is lower than the boosting voltage, wherein the armature strikes the stop during a time window during the holding phase in which the temporally constant holding voltage is applied to the coil, acquiring the temporal profile of an intensity of a current flowing through the coil within the time window in which the temporally constant voltage is applied to the coil, and determining the time at which the armature strikes the stop based on an evaluation of acquired temporal profile of the intensity of the current.

7. The method of claim 6, comprising aborting the series boosting phase upon the current through the coil reaching a series maximum current.

8. An apparatus for determining a time at which a displaceably mounted armature of an actuator comprising a coil reaches a fully open position by striking against a mechanical stop after activation of the actuator, the apparatus comprising:

a device configured to:

applying a boosting voltage to the coil during a boosting phase, aborting the boosting phase by suddenly applying to the coil a voltage having a reduced magnitude or reversed polarity compared to the boosting voltage, after aborting the boosting phase, applying a temporally constant holding voltage to the coil during a holding phase, wherein the holding voltage is lower than the boosting voltage, wherein the armature strikes the stop during a time window during the holding phase in which the temporally constant holding voltage is applied to the coil, and a unit configured to:

acquire a temporal profile of an intensity of a current flowing through the coil within the time window in which the temporally constant voltage is applied to the coil, and determine a time at which the armature strikes the stop based on an evaluation of the acquired temporal profile of the intensity of the current.

* * * * *